US005083509A

United States Patent [19]

Hansen et al.

[11] Patent Number: 5,083,509

[45] Date of Patent: Jan. 28, 1992

[54] COMPACTION DEVICE

[75] Inventors: Niels K. Hansen, Northam; John D. Charters, Midland; Susanne K. Watkins, Dianella, all of Australia

[73] Assignee: Myers Holding Pty Ltd, Applecross, Australia

[21] Appl. No.: 445,681

[22] Filed: Nov. 30, 1989

[51] Int. Cl.[5] ..... B30B 15/30; B30B 1/38

[52] U.S. Cl. ..... 100/73; 100/90; 100/218; 100/226; 100/229 A; 100/255; 100/269 R

[58] Field of Search ..... 100/73, 90, 91, 211, 100/218, 229 A, 255, 226–228, 269 R, 269 A

[56] References Cited

U.S. PATENT DOCUMENTS

| | | | |
|---|---|---|---|
| 970,566 | 9/1910 | Spencer | 100/269 R X |
| 1,405,440 | 2/1922 | Randall et al. | 100/269 R X |
| 3,683,795 | 8/1972 | Harris | 100/269 R X |
| 3,688,689 | 9/1972 | Fierle et al. | 100/269 A X |
| 3,717,089 | 2/1973 | Oles et al. | 100/269 A X |
| 3,736,863 | 6/1973 | Brucker | 100/228 X |
| 3,835,767 | 9/1974 | Peterson | 100/269 A X |
| 3,835,769 | 9/1974 | Peterson | 100/269 A X |
| 3,899,967 | 8/1975 | Powers | 100/269 R |
| 4,070,962 | 1/1978 | Peterson | 100/269 R X |
| 4,444,099 | 4/1984 | Paleschuck | 100/269 R X |

FOREIGN PATENT DOCUMENTS

| | | | |
|---|---|---|---|
| 1173837 | 7/1964 | Fed. Rep. of Germany | 100/218 |
| 2234977 | 1/1974 | Fed. Rep. of Germany | 100/226 |
| 129333 | 8/1950 | Sweden | 100/269 R |
| 360610 | 11/1931 | United Kingdom | 100/211 |

*Primary Examiner*—Philip R. Coe
*Assistant Examiner*—Stephen F. Gerrity
*Attorney, Agent, or Firm*—Harness, Dickey & Pierce

[57] ABSTRACT

A pneumatically operated compaction device includes a piston compressible in the upward direction in a container having a sealable lid. Odor laden air surrounding the material to be compressed is utilized for a compression fluid as air is drawn from the chamber to be compressed and pressurably pumped the chamber providing the compressive force. A deodorizer automatically injects the compression chamber with a deodorizing fluid during each use, and which is powered by exposure to the changing pressure within the compactor.

17 Claims, 6 Drawing Sheets

65
26
27
67
83
81
87
49
53
19
29
55
-33-
15
55
25
31
37
23
17
64
51
39
-35-
22
43
41
55

COMPACTION DEVICE

TECHNICAL FIELD

This invention relates to compaction device for compacting material.

The invention has been devised particularly, but not solely, to compact refuse material to facilitate its disposal.

BACKGROUND ART

Many different types of refuse compaction means have been proposed. Some such proposals utilize air pressure to move a compaction member, such as a piston, through a compaction stroke to compact refuse material placed in a compaction space within the compaction means. Typical examples of such compaction means are those of U.S. Pat. Nos. 3,899,967 and 4,070,962 where atmospheric pressure is used to drive a compaction member through a compaction stroke. More particularly an air pressure differential created across the compaction member by evacuating air from the compaction space, is used to drive the compaction member through the compaction stroke.

These prior art devices suffer from several deficiencies. One such deficiency is that the direction of the compaction stroke of the compaction member is not in a direction towards an access opening in the compaction space through which refuse material may be introduced into, and compacted refuse material may be removed from, the compaction space. As a consequence of this, the refuse material after compaction is remote from the opening and may be difficult to remove from the compaction space. Additionally, the compaction member cannot be utilized to urge the compacted material from the compaction space.

A further deficiency of the aforementioned prior art compaction means is that air evacuated from the compaction space is discharged to atmosphere and obnoxious odors may be discharged with the air.

A still further deficiency of the aforementioned prior art compaction means is the difficulty in closing the access opening in a convenient manner and in a manner which provides an effective seal.

SUMMARY OF THE INVENTION

It is a primary object of this invention to provide a novel and useful compaction means.

It is a preferred object of this invention to overcome at least one of the aforementioned deficiencies of prior art compaction means.

In one form, the invention resides in a compaction device comprising a body defining a chamber, a piston means slidably and sealingly mounted in the chamber and dividing the chamber into a compaction space and a secondary space, an access opening for insertion of material into and removal of compacted material from the compaction space, closure means for selectively closing said access opening, and operating means for selectively evacuating air from one space and delivering air into the other space to effect movement of the piston means through the chamber thereby to vary the volume of the compaction space.

Preferably, air evacuated from one space is delivered to the other space. This is a beneficial feature in that it inhibits escape of obnoxious odors which may be present in air which in use is transferred between the two spaces.

If desired, a filtering means may be provided to filter air being transferred between the two spaces.

Preferably, the access opening in the body is substantially aligned with the compaction stroke of the piston means and is located adjacent the terminal end of the compaction stroke.

Preferably, a sealing means is provided having a sealing condition which provides an air seal between the closure means and the body and a non-sealing condition in which no such seal is provided and an actuating means being operable to effect movement of the sealing means between said sealing and non-sealing conditions, said actuating means being operable to effect movement of the sealing means into said sealing condition when contacted by material undergoing compaction in the compaction chamber.

Preferably, the sealing means comprises a sealing ring expansible for compressible sealing contact with both the body and the closure means so as to provide an air seal therebetween when in said sealing condition.

Preferably, the actuating means is mounted on the closure means for limited movement towards and away from the closure means whereby the sealing ring is caused to assume an expanded condition upon movement of the actuating means towards the closure means.

Preferably, the sealing ring is confined between the closure means and a face of the actuating means adjacent the periphery of the actuating means whereby said face urges the sealing ring into said expanded condition upon movement of the actuating means towards the closure means.

Preferably, the closure means comprises a lid hingedly mounted on the body for pivotal movement between opened and closed positions relative to said opening, and releasable locking means for selectively locking the lid in the closed position.

Preferably, said chamber has a substantially cylindrical side wall, a bottom wall and an open top which defines said access opening.

Preferably, the compaction means further comprises means for selectively delivering a charge of deodorizing composition into the compaction space.

Preferably, the means for delivering the charge of deodorizing composition comprises a reservoir for containing a supply of deodorizing composition, a delivery chamber having a movable wall to vary the volume of the delivery chamber, said movable wall being responsive to air pressure in the compaction space whereby the wall is caused to undergo an expansion stroke in response to evacuation of air from within said compaction space so as to increase the volume of the delivery chamber and to undergo a return stroke on an increase in air pressure in the compaction space, and a delivery path extending between the delivery chamber and said compaction space whereupon an expansion stroke of the wall a quantity of deodorizing composition is drawn from the reservoir into the delivery chamber and upon a return stroke of the wall the deodorizing composition in the delivery chamber is forced along the delivery path and delivered into said compaction space.

In another form, the invention resides in a compaction device comprising a body defining a compaction space to receive material to be compacted, an access opening for insertion of material into and removal of compacted material from the compaction space, closure means for selectively closing the access opening, a piston means slidably and sealingly mounted within the body and defining a wall of the compaction space, the piston means being movable towards and away from said opening to vary the volume of the compaction space, means for effecting movement of the piston towards and away from said opening including means for selectively evacuating air from within the compaction space, a sealing means having a sealing condition in which there is provided an air seal between the closure means and the body and a non-sealing condition which permits opening of the closure means, and actuating means operable to effect movement of the sealing means between the sealing and non-sealing conditions, said actuating means being operable to effect movement of the sealing means into said sealing condition when said actuating means is contacted by material undergoing compaction in the compaction space.

In still another form, the invention resides in a compaction device comprising a body having a compaction space to receive material to be compacted, an access opening for insertion of material into and removal of compacted material from the compaction space, closure means for selectively closing the access opening to define a first wall of the compaction space, a piston means mounted within the body and defining a second wall of the compaction space, the piston means being movable towards and away from said opening to vary the volume of the compaction space and operating means for effecting movement of the piston towards and away from said opening.

Preferably, said operating means comprises means for creating an air pressure differential across the piston.

Preferably, the piston means is slidably and sealingly mounted in a chamber, the piston means dividing said chamber into said compaction space and a secondary space.

In one arrangement, said air pressure differential is created by introducing air into one of the said spaces.

In another arrangement, said air pressure differential is created by evacuating air from one of said spaces.

In still another arrangement, said air pressure differential is created by evacuating air from one of said spaces and introducing the evacuated air into the other of said spaces.

BRIEF DESCRIPTION OF THE DRAWINGS

The invention will be better understood by reference to the following description of one specific embodiment thereof as shown in the accompanying drawings in which.

DETAILED DESCRIPTION

Figure 1:
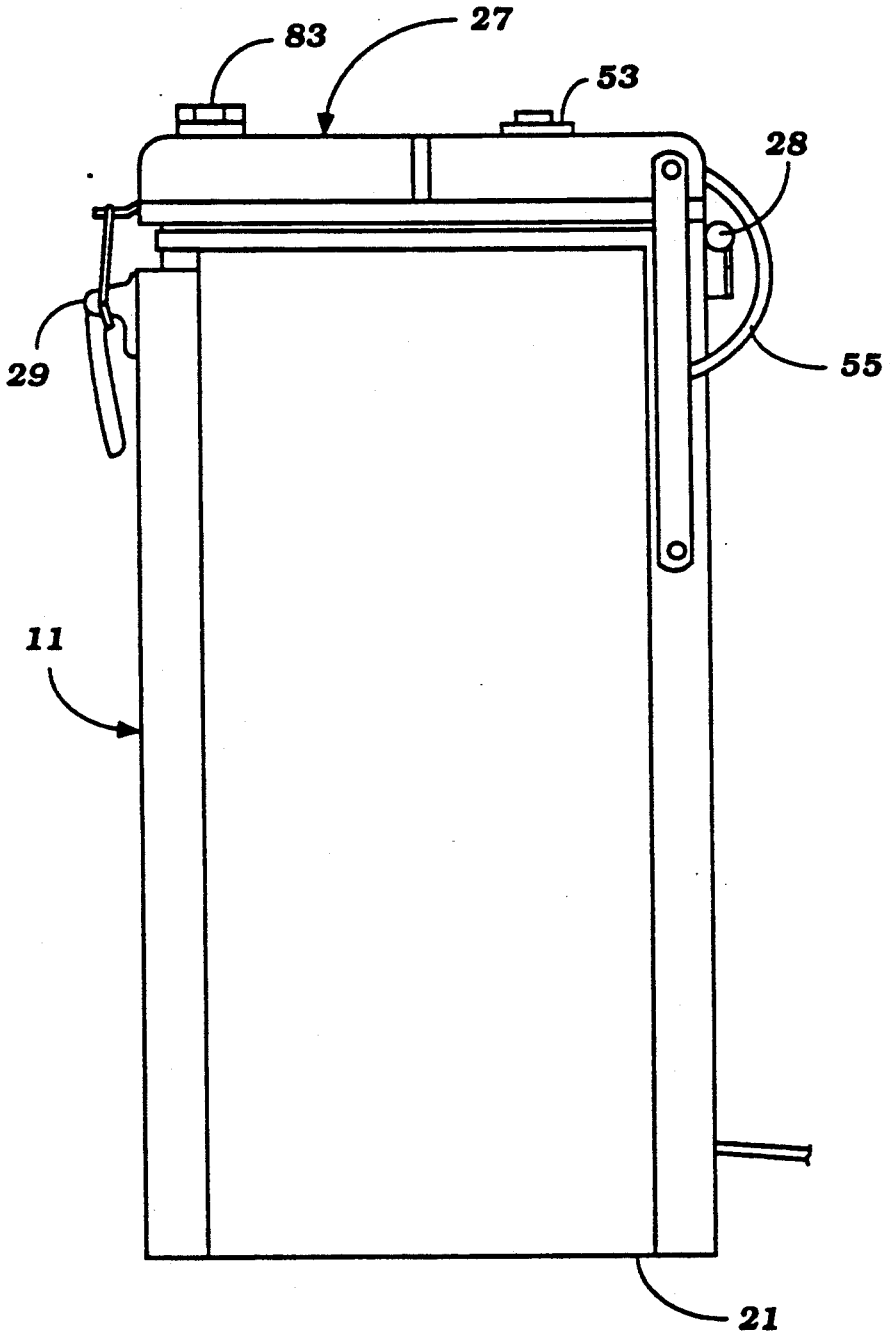
FIG. 1 is an elevational view of a refuse compactor according to the embodiment.

The embodiment shown in the drawings is directed to a refuse compactor which is particularly suitable for use in domestic situations.

Figure 2:
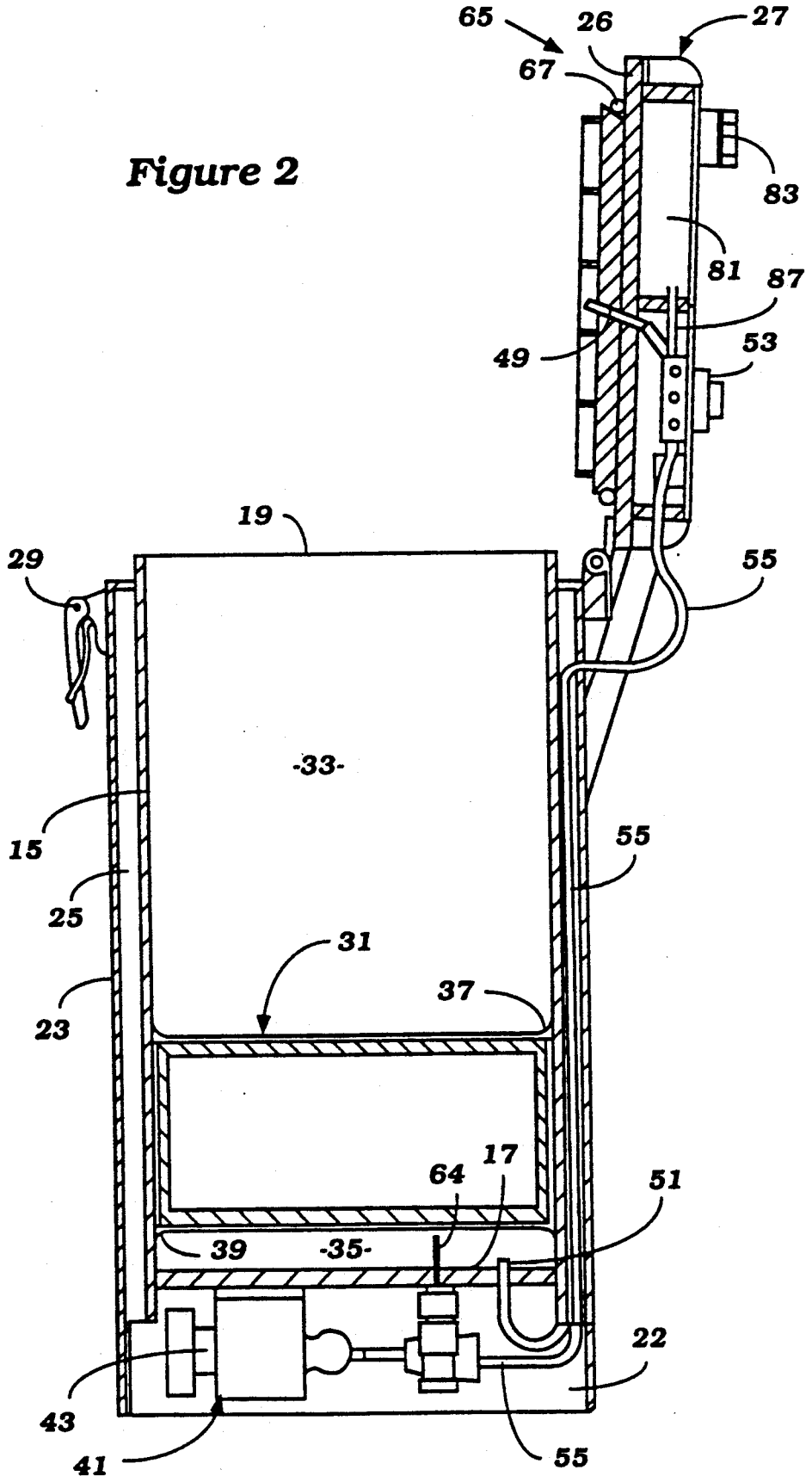
FIG. 2 is a sectional view of the refuse compactor, with the lid shown in an open position.

The refuse compactor comprises a body 11 including a chamber 13 which has a cylindrical side wall 15, a bottom wall 17 and an open top 19. The bottom wall 17 of the chamber is spaced above the bottom edge 21 of the body to define a space 22 to accommodate various parts of the compactor, as shown in FIG. 2 of the drawings. The cylindrical side wall 15 of the chamber 13 is spaced inwardly of an outer side wall 23 of the body to define an annular space 25, also as shown in FIG. 2 of the drawings.

The open top of the chamber 13 provides an access opening for the chamber. A closure means 27 in the form of a lid is hingedly mounted at 28 to the body 11 for pivotal movement between opened and closed positions in relation to the access opening 19. A locking means 29 is provided for releasably locking the lid in the closed position.

A piston 31 is slidably and sealingly mounted in chamber 13 for axial movement therealong. The piston 31 divides the chamber 13 into upper and lower spaces, the upper space 33 being a compaction space and the lower space 35 being a secondary space. The piston 31 is provided with upper and lower sealing elements 37 and 39 respectively which are in sealing contact with the side wall 15 of the chamber 13.

Operating means 41 are provided for selectively evacuating each of the spaces 33 and 35 and delivering the evacuated air into the other space so as to create a pressure differential across the piston 31 to effect movement of the piston through the chamber 13. The operating means 41 includes a pump 43 having an intake 45 and a discharge 47 which can be selectively connected for fluid communication with an upper port 49 opening into the compaction space 33 and a lower port 51 opening into the secondary space 35 under the control of a control valve 53 having three control positions. Thus, with the control valve in a first control position, air can be evacuated from compaction space 33 through upper port 49 and admitted into the secondary space 35 through lower port 51. Similarly, with the control valve 53 in a third control position, air can be evacuated from secondary space 35 through lower port 51 and admitted into compaction space 33 through upper port 49. The function of the second control position of the control valve will be described later.

The pump 43 and upper and lower ports 49 and 51 respectively are connected for fluid communication by flow lines 55.

A timer 56 is associated with the control valve and is adapted to be actuated to commence a timing cycle when the control valve 53 is placed in the first control position.

Although refuse material can be placed directly into compaction space 33, it is preferable from the standpoint of hygiene and ease of disposal of compacted material that a removable bag be inserted into the compaction space to receive refuse material. In such circumstances, the upper portion of the bag defining the open mouth thereof would be turned over the upper edge of the cylindrical side wall 15 of the chamber. This is illustrated in FIG. 3 of the drawings which shows bag 57 received in the compaction space and the upper portion 59 of the bag is folded over the upper edge of the side wall 15 of the compaction space.

Figure 3:
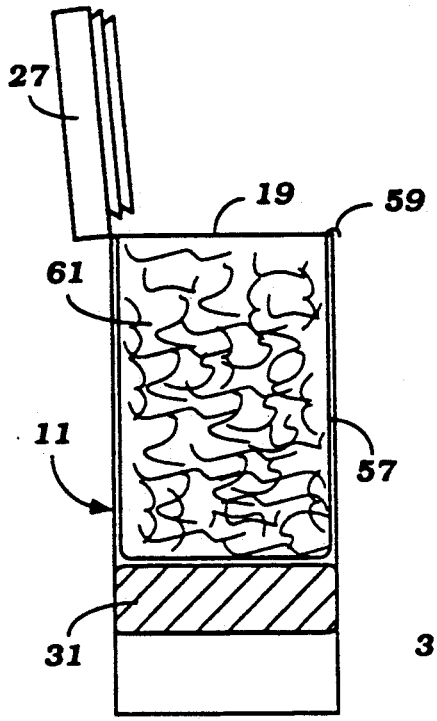
FIGS. 3 to 8 illustrate various stages of a compaction operation performed by the refuse compactor.
Figure 4:
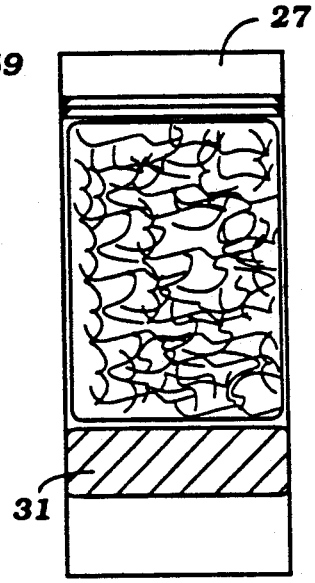
Figure 5:
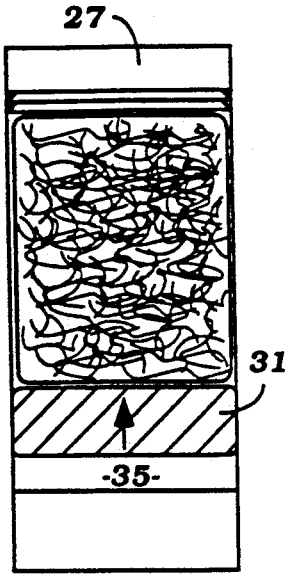
Figure 6:
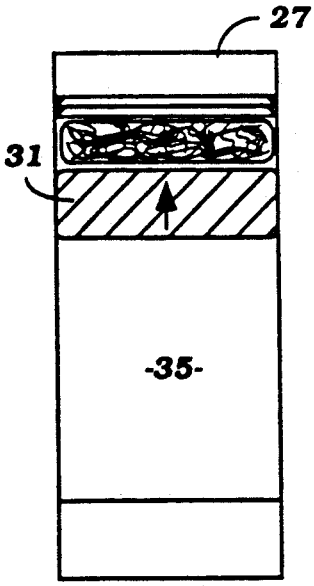

A compaction operation performed by the refuse compactor is illustrated in FIGS. 3 to 8 of the accompanying drawings. FIG. 3 illustrates the compactor in a position to receive refuse material 61 in the bag 57 positioned within the compaction space. When the compaction space is full, lid 27 is closed and locked in that position, as shown in FIG. 4 of the drawings. The control valve 53 is then turned to the first control position which actuates the air pump 43 and the timer 56. The pump evacuates air from compaction space 33 through port 49 and delivers the evacuated air to secondary space 35 through port 51. This creates a pressure differential across piston 31 and causes the piston to move upwardly through chamber 13 thereby compressing the refuse material 61 within the compaction space, as shown in FIG. 5 of the drawings. It will be noted that the refuse material is compressed against the closed access opening 19. Operation of the pump is controlled by the timer 56 and at the end of the timing cycle the operation of the air pump 43 is terminated. The timing cycle of timer 56 is arranged such that the piston would have completed compaction of the refuse material, as illustrated in FIG. 6 of the drawings.

Figure 7:
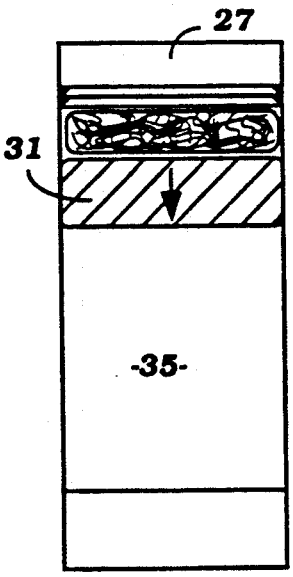
Figure 8:
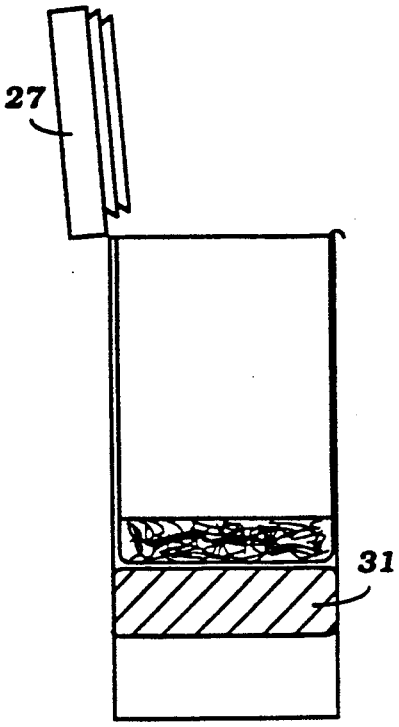
Figure 9:
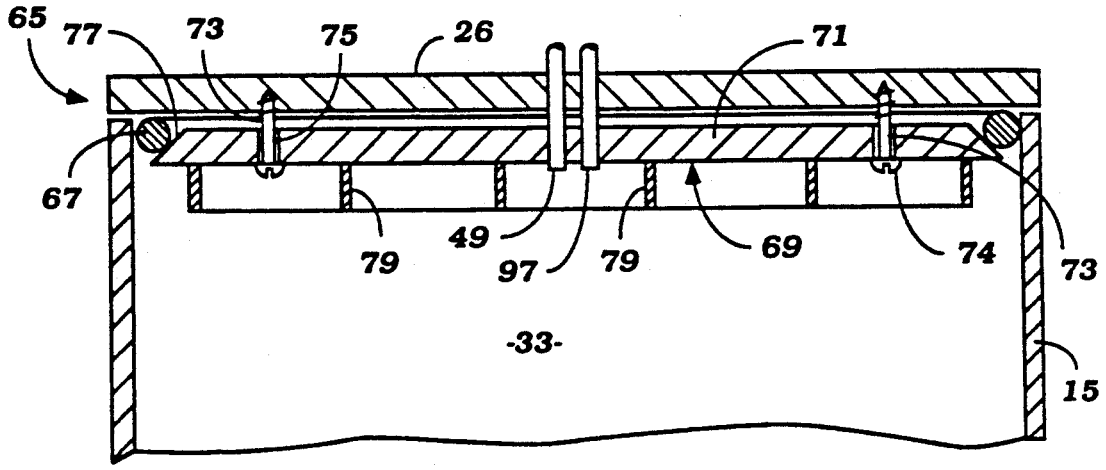
FIG. 9 is an enlarged fragmentary section through the lid and upper portion of the compaction space of a refuse compactor and illustrating sealing means in a non-sealing condition.

At this stage, the control valve is turned to its second position which permits injection of deodorizing composition into the compacted refuse material. Thereafter, the control valve is moved to the third position in which air is evacuated from secondary space 35 through port 51 and delivered into compaction space 33 through port 49. This creates a pressure differential across the piston in the reverse direction and so causes the piston to move in a downward direction thereby progressively increasing the volume of the compaction space, as illustrated in FIG. 7 of the drawings. As the piston approaches its lowermost position it operates an actuating element 64 which causes operation of pump 43 to be terminated. The lid 27 can now be opened to receive additional refuse material, as illustrated in FIG. 8 of the drawings. When the bag 57 containing compacted refuse material is to be removed from the compactor, the lid 27 is opened and the control valve 53 is moved into the first control position to actuate pump 43. In such circumstances air would not be evacuated from the open compaction space but would still be delivered to the secondary space 35 to move the piston through its compaction stroke. The effect of this would be to move the bag of compacted material upwardly and out through the access opening 19. Without assistance from the piston, it would be very difficult to extract the bag of compacted material from the compaction space.

It will be noted that during the compaction operation, bag 57 collapses during the compaction stroke but returns to its normal position on the return stroke of the piston.

Figure 10:
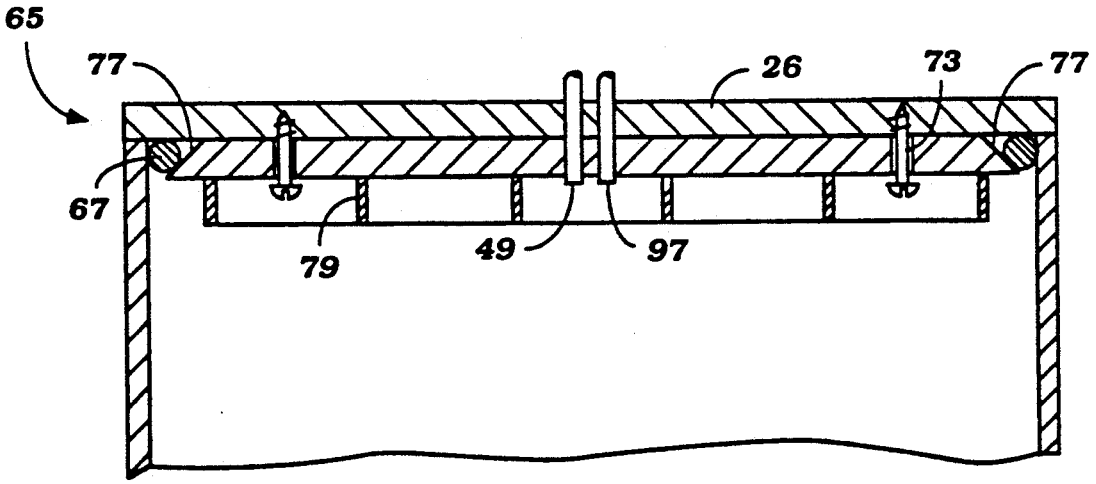
FIG. 10 is a view similar to FIG. 9 with the exception that the sealing means is shown in a sealing condition which provides a seal between the lid and the compaction space.
Figure 11:
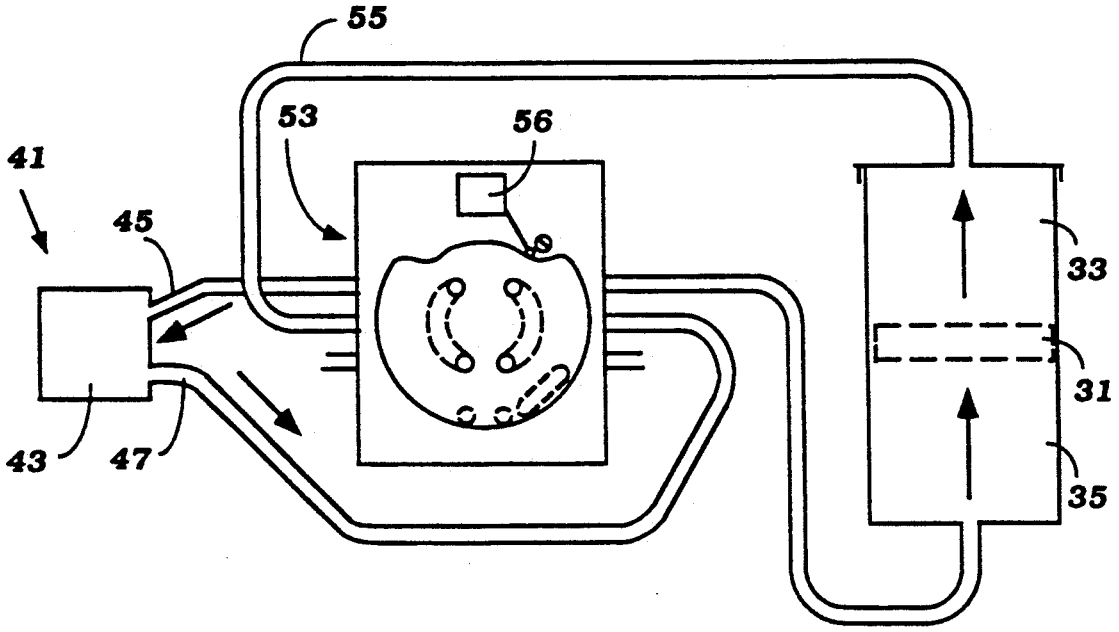
FIG. 11 is a schematic view of operating means for creating an air pressure differential across the piston means, said operating means including a control valve which is shown in a position corresponding to a compaction stroke of the piston.
Figure 12:
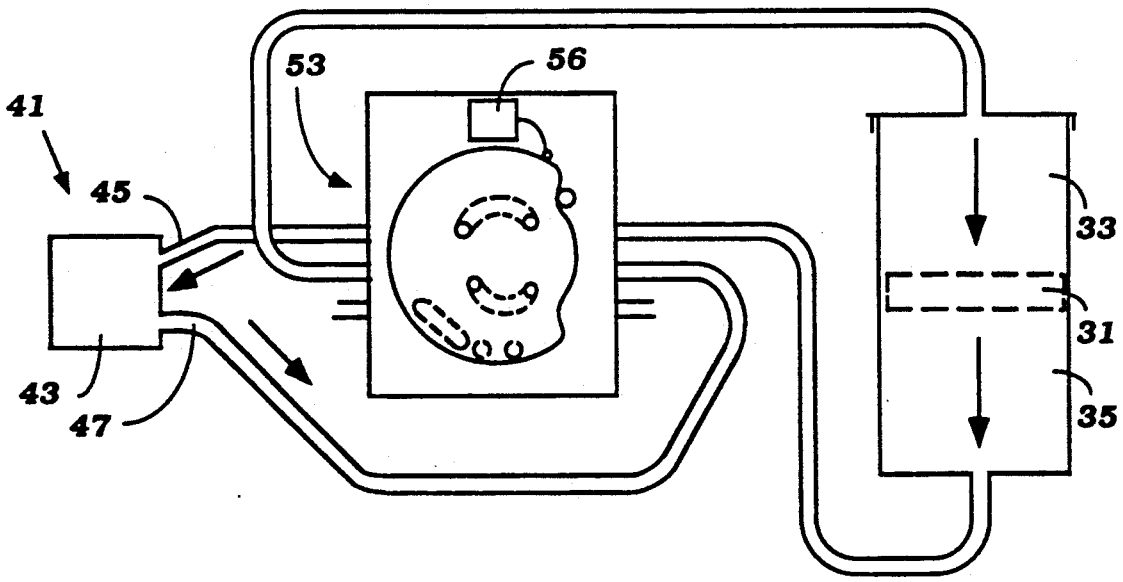
FIG. 12 is a view similar to FIG. 11 with the exception that the control valve is in a position corresponding to a return stroke of the piston.

The refuse compactor has a sealing means 65 operable to provide a seal between the lid 27 and the side wall 15 of the chamber 13 during a stage of the compaction stroke of the piston to facilitate evacuation of air from the (as shown in the drawings) and the sealing ring is confined between the peripheral face and the lower part 26 of the lid. When the lid is in its closed position, the plate 71 assumes its lowermost position under the action of gravity, thus allowing the sealing ring 67 to assume a non-sealing condition. Upon movement of the plate 71 in an upward direction towards the lid, the sealing ring 67 is caused to expand radially and to move upwardly so as to make sealing contact with both the inner face of the wall 15 of the chamber and the lower part 26 of the lid, as shown in FIG. 10 of the drawings.

Movement of the plate 71 in the upward direction is caused by refuse material undergoing compaction in the compaction space 33. That is to say, as the refuse material is urged upwardly against the closed top of the compaction space in response to upward movement of the piston, the refuse material pushes against the underside of the plate and causes the latter to also move upwardly and cause the sealing ring 67 to assume the sealing condition.

The underside of the plate 71 is provided with elements 79 which present an irregular surface to the refuse material undergoing compaction which provides point loadings to certain parts of the refuse material so as to assist in collapsing cartons, tins and like objects which may be present in the refuse.

Figure 13:
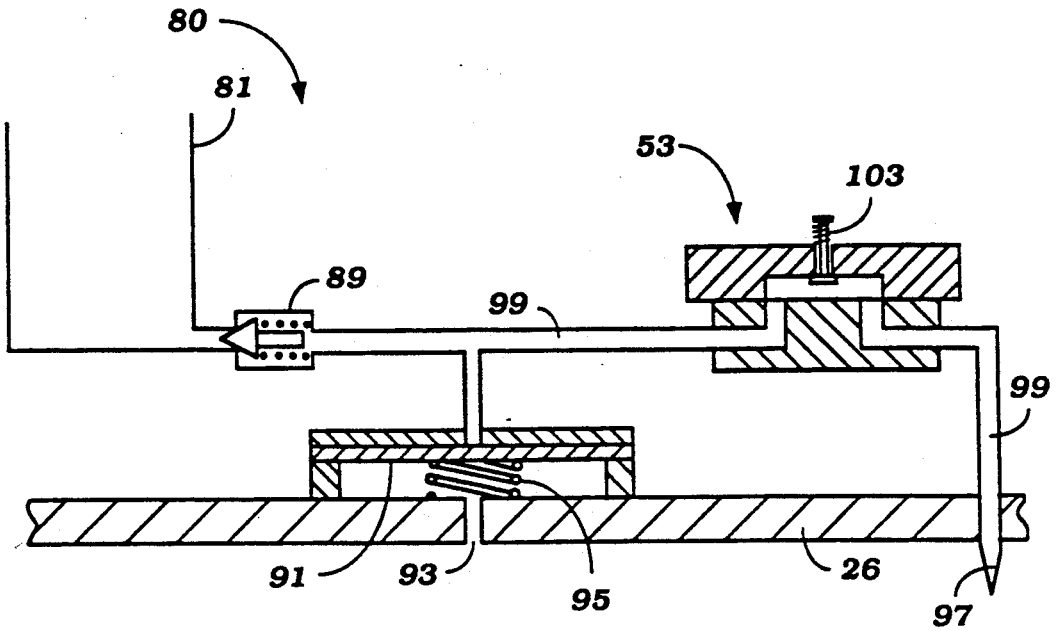
FIG. 13 is an enlarged fragmentary view of delivery means for delivering a charge of deodorizing composition into the compaction space, with the delivery chamber being shown in a contracted condition.
Figure 14:
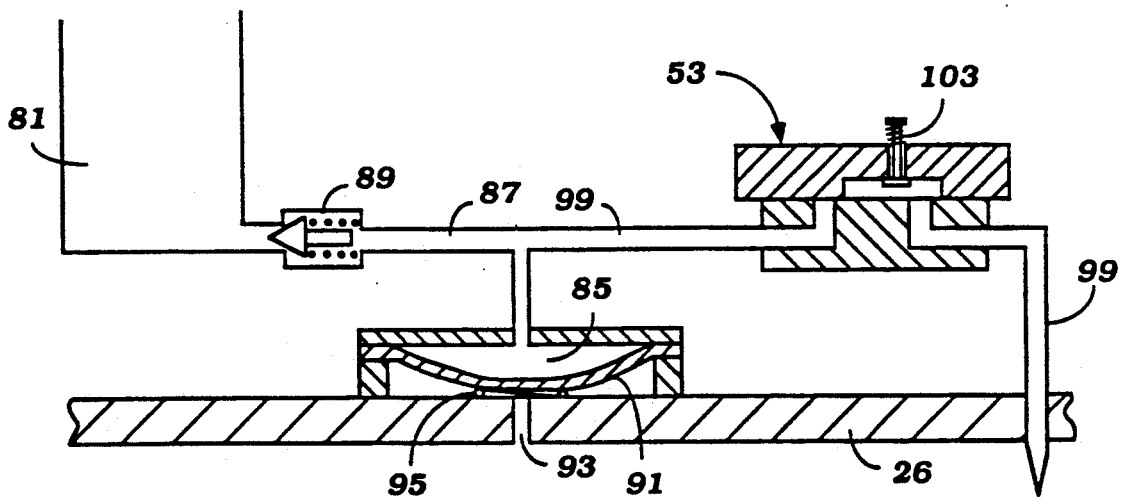
FIG. 14 is a view similar to FIG. 13 with the exception that the delivery chamber is shown in an expanded condition.

As previously mentioned, a deodorizing liquid is injected into the compacted refuse material after the compaction stroke. A delivery means 80 for delivering a charge of deodorizing composition into the compaction space is illustrated in FIGS. 13 and 14 of the drawings. The delivery means 80 is accommodated in the lid 27 and includes a reservoir 81 for containing a supply of deodorizing liquid. The reservoir 81 is provided with a filler 83 through which deodorizing composition may be introduced into the reservoir. The reservoir 81 is connected to a delivery chamber 85 by way of a flow line 87 which incorporates a one-way valve 89. The delivery chamber has a wall 91 which is movable to vary the volume of the chamber. The side of the wall 91 remote from the delivery chamber 85 communicates with the compaction space 33 when the lid is in a closed position by way of a port 93 formed within the lower part 26 of the lid. With this arrangement, air pressure (or vacuum) which exists within the compaction space is applied to the wall 91 of the chamber 85. In this way, wall 91 is caused to distend in an outward direction to expand the volume of the chamber 85 when air is evacuated from the compaction space the distention being against the influence of a spring 95 acting on the wall. Expansion of the delivery chamber 85 causes a quantity of deodorizing composition contained within reservoir 81 to be induced into the chamber along flow line 87. The delivery chamber 85 is connected for fluid communication with a delivery nozzle 97 by (which is mounted on the lower part 26 of the lid) way of a delivery line 99. The control valve 53 is incorporated in delivery line 99 and is arranged to open the flow path along flow line 99 when in its second control position and to close the flow path when in its first and third control positions. The control valve also incorporates a venting valve 103 which vents the compaction space when the control valve is in the second control position.

In operation, when the control valve is in the first control position (thereby to cause air to be evacuated from the compaction space), the low pressure region existing on the side of wall 91 remote from the delivery chamber 85 causes the wall to deflect in a manner which expands the chamber 85 and induces a charge of deodorizing liquid from the reservoir to the delivery chamber. When the control valve is moved to the second control position at the end of the compaction stroke, the compaction space is vented (through delivery line 99 and venting valve 103) and the movable wall 91 is caused to return to its original position under the influence of spring 95. This has the effect of reducing the volume of delivery chamber 85 and displacing deodorizing liquid contained therein along delivery line 99 to nozzle 97 which delivers the liquid composition into the compaction space.

Thereafter the control valve is moved to its second position which causes evacuation of air from the secondary space 35 and delivery of air to the compaction space 33 so as to move the piston in the downward direction.

The claims defining the invention are as follows:

We claim:

1. A compaction device comprising a body defining a chamber, a piston means slideably and sealingly mounted in the chamber and dividing the chamber into a compaction space and a secondary space, an access opening for insertion of material into and removal of compacted material from the compaction space, closure means for selectively closing said access opening, operating means for selectively evacuating air from one of said spaces and delivering the same air into the other of said spaces to effect movement of the piston means through the chamber to vary the volume of the compaction space, a sealing means having a sealing condition which provides an air seal between the closure means and the body and a non-sealing condition in which no such seal is provided, and an actuating means being operable to effect movement of the sealing means between said sealing and non-sealing conditions, said actuating means being operable to effect movement of the sealing means into said sealing condition when contacted by material undergoing compaction in the compaction chamber.

2. A compaction device according to claim 1 wherein the access opening in the body is substantially aligned with the compaction stroke of the piston means and is located adjacent the terminal end of the compaction stroke.

3. A compaction device according to claim 1 wherein the sealing means comprises a sealing ring expansible for compressible sealing contact with both the body and the closure means so as to provide an air seal between the compaction space and the closure means.

4. A compaction device according to claim 3 wherein the actuating means is mounted on the closure means for limited movement towards and away from the closure means whereby the sealing ring is caused to assume an expanded condition upon movement of the actuating means towards the closure means.

5. A compaction device according to claim 4 wherein the sealing ring is confined between the closure means and a face of the actuating means adjacent the periphery of the actuating means whereby said face urges the sealing ring into said expanded condition upon movement of the actuating means towards the closure means.

6. A compaction device according to claim 5 wherein said face of the actuating means is inclined inwardly in the direction of the compaction stroke of the piston means.

7. A compaction device according to claim 1 wherein the closure means comprises a lid hingedly mounted on the body for pivotal movement between opened and closed positions relative to said opening, and releasable locking means for selectively locking the lid in the closed position.

8. A compaction device according to claim 1 wherein said chamber has a substantially cylindrical side wall, a bottom wall and an open top which defines said access opening.

9. A compaction device according to claim 1 wherein the compaction means further comprises means for selectively delivering a charge of deodorizing composition into the compaction space.

10. A compaction device according to claim 9 wherein said means for delivering the charge of deodorizing composition comprises a reservoir for containing a supply of deodorizing composition, a delivery chamber having a movable wall to vary the volume of the delivery chamber, said movable wall being responsive to air pressure in the compaction space whereby the wall is caused to undergo an expansion stroke in response to evacuation of air from within said compaction space so as to increase the volume of the delivery chamber and to undergo a return stroke on return of air into the compaction space, and a delivery path extending between the delivery chamber and said compaction space where upon an expansion stroke of the wall a quantity of deodorizing composition is drawn from the reservoir into the delivery chamber and upon a return stroke of the wall the deodorizing composition in the delivery chamber is forced along the delivery path and delivered into said compaction space.

11. A compaction device comprising a body having a compaction space to receive material to be compacted, an access opening for insertion of material into and removal of compacted material from the compaction space, closure means for selectively closing the access opening to define a first wall of the compaction space, a piston means mounted within the body and defining a second wall of the compaction space, the piston means being movable towards and away from said opening whereby to vary the volume of the compaction space and operating means for effecting movement of the piston towards and away from said opening including means for selectively evacuating air from within the compaction space, a sealing means having a sealing condition which provides an air seal between the closure means and the body and a non-sealing condition which permits opening of the closure means, and actuating means operable to effect movement of the sealing means between the sealing and non-sealing conditions, said actuating means being operable to effect movement of the sealing means into said sealing condition when said actuating means is contacted by material undergoing compaction in the compaction space.

12. A compaction device according to claim 11 wherein said sealing means comprises a sealing ring expansible for compressible sealing contact with both the body and the closure means to provide an air seal between the compaction space and the closure means.

13. A compaction device according to claim 12 wherein said actuating means is mounted on the closure means for limited movement towards and away from the closure means whereby the sealing ring is caused to assume an expanded condition upon movement of the actuating means towards the closure means.

14. A compaction device according to claim 12 wherein the sealing ring is confined between the closure means and a face of the actuating means adjacent the periphery of the actuating means whereby said face urges the sealing ring into said expanded condition upon movement of the actuating means towards the closure means.

15. A compaction device according to claim 14 wherein said face is inclined inwardly in the direction of the compaction stroke of the piston means.

16. A compaction device according to claim 11 wherein the closure means comprises a lid hingedly mounted on the body for pivotal movement between opened and closed positions relative to said opening, and releasable locking means for selectively locking the lid in the closed position.

17. A compaction device according to claim 16 wherein said chamber has a substantially cylindrical side wall, a bottom wall and an open top which defines said access opening.

* * * * *

UNITED STATES PATENT AND TRADEMARK OFFICE

CERTIFICATE OF CORRECTION

PATENT NO. : 5,083,509

DATED : January 28, 1992

INVENTOR(S) : Hansen, et al

It is certified that error appears in the above-identified patent and that said Letters Patent is hereby corrected as shown below:

On the Title Page, insert the following information:

--PCT Filed: May 19, 1988--
--PCT No.: PCT/AU88/00143--

--371 Date: Nov. 30, 1989--
--102(e) Date: Nov. 30, 1989--

--PCT Pub. No. WO 88/09264--
--PCT Pub. Date: Dec. 1, 1988--

On the Title Page, insert the following heading and information:

--Foreign Application Priority Data--

--May 19, 1987 [AU] Australia .....PI2005--
--Aug. 6, 1987 [AU] Australia .....PI3627--
--Feb. 4, 1988 [AU] Australia .....PI6607--

Signed and Sealed this

Thirty-first Day of August, 1993

Bruce Lehman

*Attest:*

BRUCE LEHMAN

*Attesting Officer*

*Commissioner of Patents and Trademarks*